US011624139B2

(12) United States Patent
Mizer et al.

(10) Patent No.: US 11,624,139 B2
(45) Date of Patent: Apr. 11, 2023

(54) HORIZONTAL AXIS LAUNDRY TREATMENT MACHINE HAVING CORNER ENTRY

(71) Applicant: The Procter & Gamble Company, Cincinnati, OH (US)

(72) Inventors: Scott Eugene Mizer, Loveland, OH (US); Benny Leung, Wyoming, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 7 days.

(21) Appl. No.: 17/032,836

(22) Filed: Sep. 25, 2020

(65) Prior Publication Data

US 2021/0095410 A1 Apr. 1, 2021

(30) Foreign Application Priority Data

Sep. 27, 2019 (EP) ..... 19200044

(51) Int. Cl.
*D06F 37/10* (2006.01)
*D06F 23/02* (2006.01)
(Continued)

(52) U.S. Cl.
CPC ..... *D06F 37/10* (2013.01); *D06F 23/02* (2013.01); *D06F 25/00* (2013.01); *D06F 39/14* (2013.01)

(58) Field of Classification Search
CPC ..... D06F 23/02; D06F 25/00; D06F 37/10; D06F 39/14
See application file for complete search history.

(56) References Cited

U.S. PATENT DOCUMENTS 5,398,528 A 3/1995 Johnston
5,437,168 A * 8/1995 Mason ..... D06F 37/10 68/3 R
(Continued)

FOREIGN PATENT DOCUMENTS

DE 69006404 T2 3/1994
EP 0406115 A1 1/1991
(Continued)

OTHER PUBLICATIONS

International Search Report and Written Opinion; Application Ser. No. PCT/US2020/070578; dated Nov. 4, 2020, 13 pages.
(Continued)

*Primary Examiner* — Joseph L. Perrin
(74) *Attorney, Agent, or Firm* — Gary J. Foose

(57) ABSTRACT

A laundry treatment machine including: a cabinet; a tub within the cabinet; a horizontal axis fluid pervious drum within the tub rotatable about a horizontal axis, wherein the drum has a diameter orthogonal to the horizontal axis and an average width in line with the horizontal axis and a ratio of diameter to average width from 1.5:1 to 3.25:1; a circumferential entry section into the tub that spans at least across an intermediate range of from 30 degrees to 60 degrees above and rotationally about the horizontal axis and is bounded within a front position of more than 2 degrees above and rotationally about the horizontal axis and a top position less than 90 degrees above and rotationally about the horizontal axis; and a door in the cabinet, the door sealingly engaged with the entry section.

7 Claims, 6 Drawing Sheets

(51) Int. Cl.
*D06F 25/00* (2006.01)
*D06F 39/14* (2006.01)

(56) References Cited

U.S. PATENT DOCUMENTS 5,448,900 A * 9/1995 Cuthbert ..... D06F 37/28 68/139
5,546,772 A * 8/1996 Merlin ..... D06F 37/28 68/24
D503,835 S 4/2005 Oda
7,073,356 B2 7/2006 Nakamura
7,600,403 B2 10/2009 Chang
2003/0061841 A1 4/2003 Nakamura
2004/0144138 A1* 7/2004 Takeuchi ..... D06F 39/14 68/24
2005/0257812 A1* 11/2005 Wright ..... D06F 43/007 134/42
2007/0101602 A1* 5/2007 Bae ..... D06F 58/206 62/3.4
2007/0251023 A1 11/2007 Koo
2009/0260404 A1* 10/2009 Saito ..... D06F 39/08 68/20
2016/0289885 A1* 10/2016 Kim ..... D06F 58/206

FOREIGN PATENT DOCUMENTS

EP 0718431 A1 6/1996
EP 1925705 A1 5/2008
JP 09122374 A 5/1997
KR 20060117526 A 11/2006
WO 2004099484 A1 11/2004

OTHER PUBLICATIONS

European Search Report for Application No./Patent No. 19200044.6-1016, dated Feb. 18, 2020, 9 pages.

* cited by examiner

HORIZONTAL AXIS LAUNDRY TREATMENT MACHINE HAVING CORNER ENTRY

FIELD OF THE INVENTION

The present invention relates to an automatic laundry treatment machine.

BACKGROUND OF THE INVENTION

Automatic laundry treatment machines are commonly employed to perform laundry treatment processes that can include cleaning and or imparting another benefit to the laundry being treated. Most automatic laundry treatment machines employ similar features and processes to accomplish the task of treating laundry. Laundry is placed in a cylindrical fluid pervious drum within a tub, which is at least partially filled with water or a laundry treatment liquor before, during, or after the laundry is placed in the drum.

Automatic laundry treatment machines are most commonly available as one of a top loading machine having a drum mounted on a vertical axis and a front loading machine having a drum mounted on a horizontal axis. Users typically carry a basket or bag of laundry to the machine to clean the laundry. In absence of a table or adjacent appliance having a flat top surface, the user typically, and inconveniently, places the basket or bag of soiled laundry on the floor in front of the machine before transferring the soiled laundry from the basket or bag into the machine.

In the case of a top loading machine, the user typically bends over to grasp one or more articles of laundry, stands up while holding the articles, and drops the articles into the drum. The user may be required inconveniently to bend over and stand up multiple times to transfer a full load of laundry from the basket or bag into the drum. If the top loading machine is in a crowded environment, there may only be room to place the basket or bag of soiled laundry directly in front of the machine. This can require the user to position his or her feet an appreciable distance away from the machine, which may require the user to reach out to place the soiled laundry into the drum. Once the load of laundry has been treated, the user opens the top and typically reaches deeply into the drum to grasp the laundered articles to remove them from the drum. For machines having a deep drum, it may be inconvenient for slightly built users to reach all the way to the bottom of the drum. Furthermore, many users do multiple loads of laundry back to back to one another. When one load is completed, the next load may be in a basket or bag in front of the machine. This can further inconvenience the user by possibly requiring the user to reach out over the next load of laundry to reach deeply into the drum to retrieve the laundered articles.

The aforesaid complications with respect to top loading machines are magnified for front loading machines. A laundry basket or bag placed in front of the machine can obstruct opening of the door of the machine and the user may be required to bend over to transfer laundry from the basket or bag into the drum and be required to reach deeply into the drum to retrieve laundered articles.

Notwithstanding the ergonomic and functional limitations of top loading and front loading machines, there is a global trend towards urbanization, which for many people means living in small living spaces. Small living spaces such as apartments often do not have a separate laundry room, since space is at a premium. People who need an automatic laundry treatment machine often must store and use the machine in areas of their apartment including the kitchen, living room, and bedroom. This makes traditional top loading and front loading machines functionally undesirable since so much space is required for the user to use and store the machine.

With these limitations in mind, there is a continuing unaddressed need for a laundry treatment machine that enables a user to store and conveniently and ergonomically use the machine in a small living space.

SUMMARY OF THE INVENTION

A laundry treatment machine including: a cabinet; a tub within the cabinet; a horizontal axis fluid pervious drum within the tub rotatable about a horizontal axis, wherein the drum has a diameter orthogonal to the horizontal axis and an average width in line with the horizontal axis and a ratio of diameter to average width from 1.5:1 to 3.25:1; a circumferential entry section into the tub that spans at least across an intermediate range of from 30 degrees to 60 degrees above and rotationally about the horizontal axis and is bounded within a front position of more than 2 degrees above and rotationally about the horizontal axis and a top position less than 90 degrees above and rotationally about the horizontal axis; and a door in the cabinet, the door sealingly engaged with the entry section.

DETAILED DESCRIPTION OF THE INVENTION

Automatic laundry treatment machines are commonly employed to treat laundry. Laundry treatment machines are most commonly used for cleaning laundry and are often referred to as laundry washing machines. Laundry treatment machines can also be used for more than just cleaning. For instance, laundry treatment machines are often employed to soften laundry. Other treatments imparted to laundry via laundry treatment processes are targeted to providing anti-wrinkle benefits, anti-static benefits, scent benefits, malodor benefits, anti-microbial benefits, color rejuvenation, color stabilization, stain removal or treatment benefits, stain resistance benefits, color enhancement benefits, insect repellant benefits, and the like. Automatic laundry treatment machines are machines that once initiated by the user automatically carry out processes for treating laundry and are powered by electricity.

The automatic laundry treatment machines can dispense laundry treatment active compositions for treating the laundry during the process for treating laundry. Laundry treatment active compositions can refer to any one or more compositions for treating laundry including but not limited to surfactants (nonionic, anionic, zwitterionic, amphoteric, and cationic), detergents, cleaning agents, chelants, perfumes, hueing dyes, enzymes, bleaching agents, oxidizing agents, builders, soil release polymers, deposition aids, anti-deposition agents, fabric enhancing agents, softening agents including but not limited to silicones, cationic surfactants and cationic polymers. The laundry treatment active compositions can be formulated laundry treatment active compositions comprising multiple components or can be provided or added to the stationary treatment chamber or tub or used in the process as a single active composition added to the stationary treatment chamber or tub or process or added in a sequence of one or more active compositions or formulated compositions added during any of one or more sub-cycles of laundry treatment process, or in any combination thereof. The laundry treatment active compositions can include formulating aids, solvents, stabilizing aids, or other materials to aid in formulation, stability, manufacture, processing, or delivery of the composition. The automatic laundry treatment machines and processes can also use suds suppressors.

Figure 1:
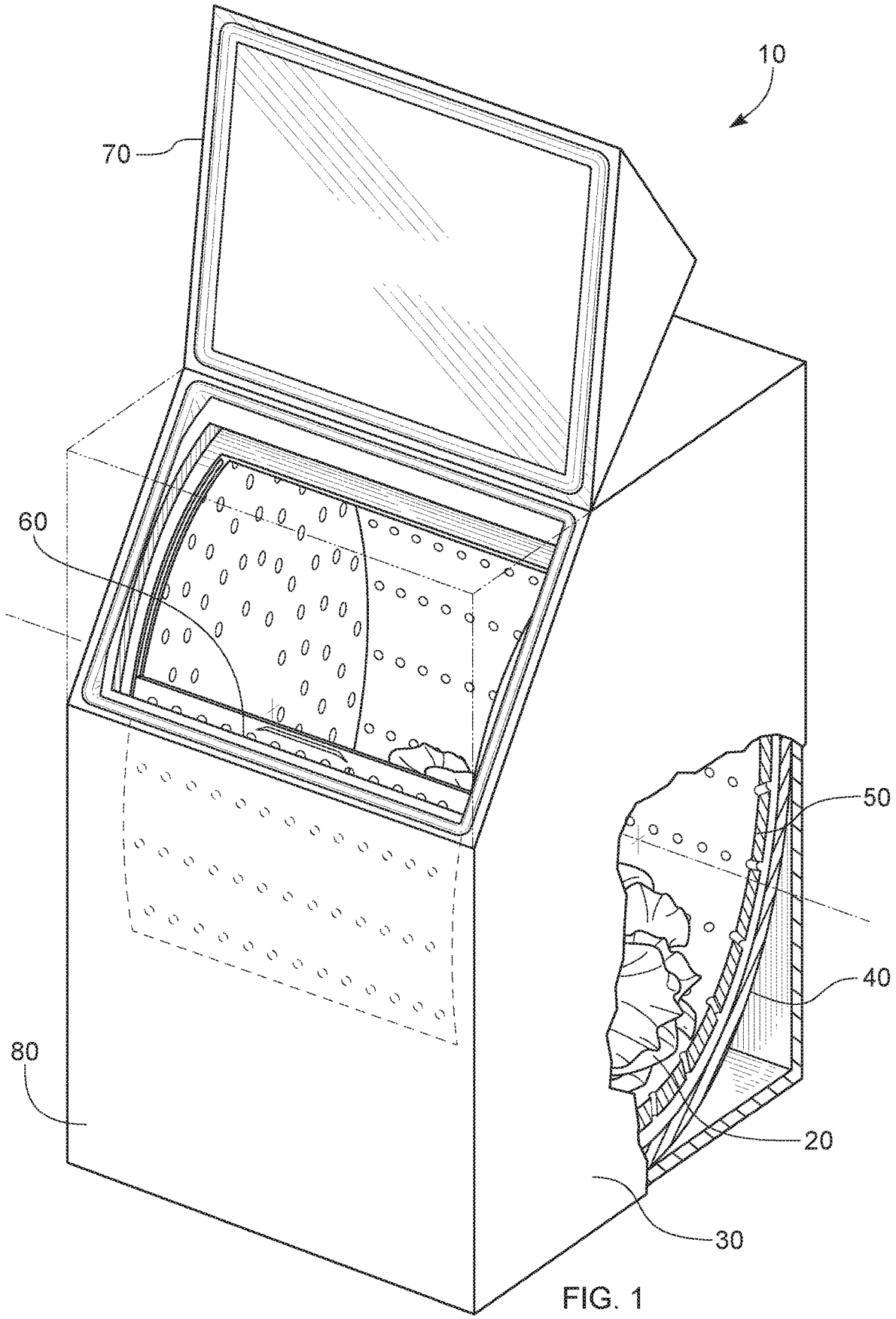
FIG. 1 is a partial perspective view of a laundry treatment machine, the door in the closed position rendered in double dot dashed lines.

An automatic laundry treatment machine 10 is shown in FIG. 1. The automatic laundry treatment machine 10 shown in FIG. 1 provides for what can be referred to as a top corner loading automatic laundry treatment machine 10, in contrast to top loading and front loading machines. The automatic laundry treatment machine 10 can be suitable for treating laundry 20 with a laundry treatment liquor. The laundry treatment machine 10 can comprise a cabinet 30, a tub 40 within the cabinet 30, and a horizontal axis fluid pervious drum 50 within the tub 40.

A circumferential entry section 60 into the tub 40 can be provided. The user of the automatic laundry treatment machine 10 can place articles of laundry 20 into and remove such articles from the drum 50 through the circumferential entry section 60. Considering that the drum 50 of the laundry treatment machine 10 is cylindrically shaped, in principle not withstanding local features such as fins, apertures, and other irregular interior surface contours, access to the drum 50 is through an opening in the circumferential wall of the drum 50, as opposed to one of the circular surfaces through which the horizontal axis H passes. Similarly, access to the tub 40 is provided in a direction into the circumferential wall of the drum 50.

The laundry treatment machine 10 can comprise a door 70 in the cabinet 30. The door 70 can be sealingly engaged with the entry section 60. The door 70 can be opened to present the circumferential entry section 60 to the user so that articles of laundry 20 can be placed into or removed from the drum 50 through the circumferential entry section 60. Before initiating a laundry treatment cycle, the user can close the door 70 to be sealingly engaged with the circumferential entry section 60. Sealing engagement can be provided for by a gasket around the periphery of the door 10 and or a gasket around the circumferential entry section 60. A bellows gasket can be practical for providing such sealing. The door 70 can be opened to interrupt the laundry treatment cycle or upon completion of the laundry treatment cycle.

Figure 2:
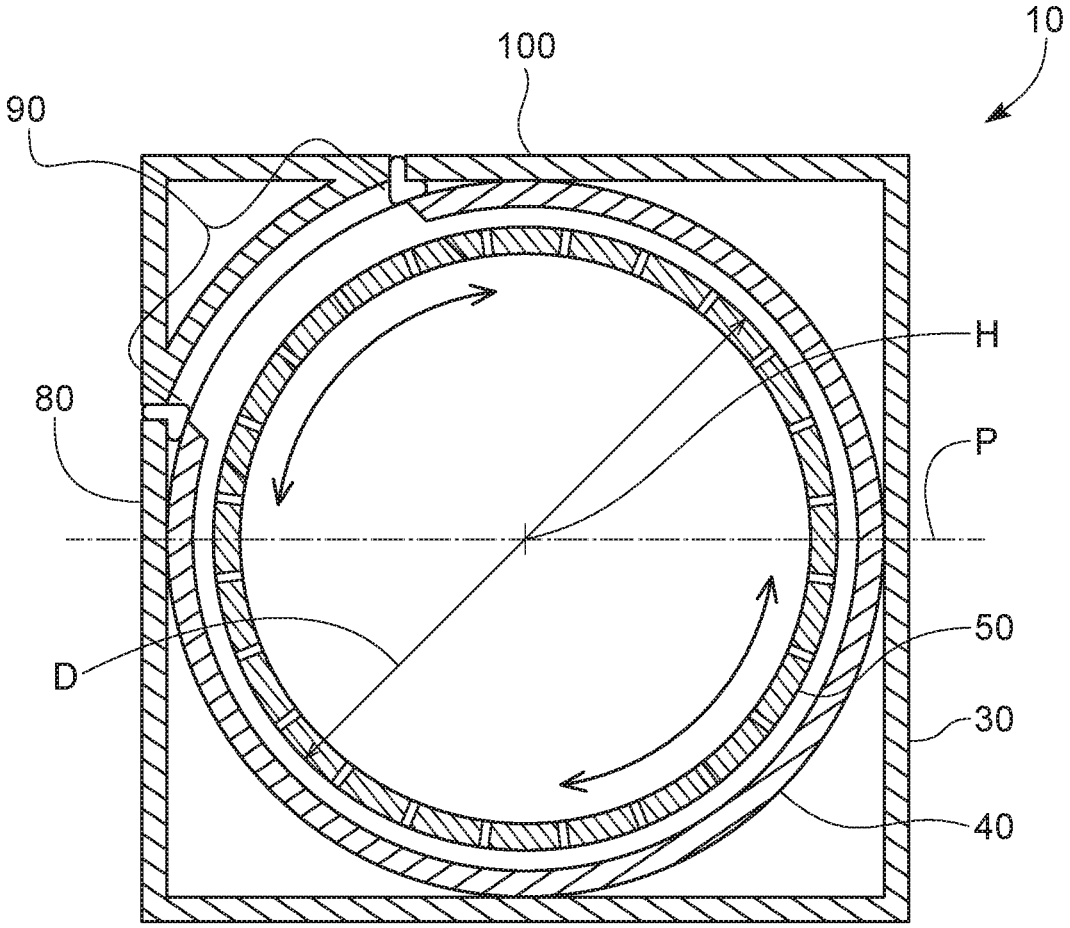
FIG. 2 is a cross section view of laundry treatment machine.

The drum 50 can be mounted on a horizontal axis H, as shown in FIG. 2. In FIG. 2, a cross sectional view of the drum 50 and tub 40 are shown and are viewed from the right side of the laundry treatment machine 10 of FIG. 1. In FIG. 2, the door 70 is closed. The door 70 has an interior facing surface. When the door 70 is closed, the interior facing surface of the door 70 closes the tub 40. The horizontal axis H in FIG. 2 spans into and out of the surface upon which FIG. 2 is viewed. The circumferential entry section 60 into the tub 40 can be bounded within a front position of more than 2 degrees above and rotationally about the horizontal axis H and a top position less than 90 degrees above and rotationally about the horizontal axis H. Such a circumferential entry section 60 provides for corner entry.

The circumferential entry section 60 in the tub 40 spans at least across an intermediate range 90 from 30 degrees to 60 degrees above and rotationally about the horizontal axis H. Providing the circumferential entry section 60 across such minimum range provides for a large enough circumferential entry section 60 to make it convenient for the user to place into and remove from the drum 50 articles of laundry 20. Further, such minimum range and having the circumferential entry section 60 located within such range provides for a circumferential entry section 60 that conveniently connects the top 100 of the laundry treatment machine 10 to the front 80 of the laundry treatment machine.

The front 80 of the laundry treatment machine 10 is in line with the horizontal axis H and upright relative to the surface upon which the laundry treatment machine 10 rests. The top 100 of the laundry treatment machine 10 is also in line with the horizontal axis H and the horizontal axis H is between the top 100 and the surface upon which the laundry treatment machine 10 rests.

In use, the laundry treatment machine 10 will rest upon a horizontal or substantially horizontal floor. In describing the radial positions of features of the laundry treatment machine it is convenient to consider positions relative to the horizontal axis H so that positions rotationally about the horizontal axis H are as set forth and described. The datum for establishing positions of elements at angles about the horizontal axis H is a horizontal plane P parallel to the surface upon which the laundry treatment machine 10 rests and passing through the horizontal axis H. The horizontal plane P is rendered in FIG. 2 as a dotted line passing through the horizontal axis H since the horizontal plane P is viewed in profile.

Bounding the position of the circumferential entry section 60 to be within a front position of more than 2 degrees above and rotationally about the horizontal axis H and a top position less than 90 degrees above and rotationally about the horizontal axis H can provide for convenient access to the tub 40 and drum 50. A position of more than 2 degrees above and rotationally about the horizontal axis H positions the lowest location of the circumferential entry section 60 proximal or above the mid-height of the laundry treatment machine 10 so that the user does not have stoop over excessively to access the interior of the laundry treatment machine 10. A top position less than 90 degrees above and rotationally about the horizontal axis H can provide for a construction in which a door 10 hinged to the top 100 of the laundry treatment machine 10 will not extend beyond the top 100 of the laundry treatment machine 10 when the door 10 is in an open position. Further, by way of this arrangement, the circumferential entry section 60 is proximal the corner area between the top 100 and the front 80 so that the interior of the laundry treatment machine 10 can be conveniently accessed by a person standing at the front 80 or a side of the laundry treatment machine 10.

The drum 50 has a diameter D, the diameter D being the outside diameter, and an average width in line with the horizontal axis H. The ratio of diameter D to average width can be from 1.5:1 to 3.25:1. Such a ratio provides for a laundry treatment machine 10 that has a slim profile that can conveniently fit snuggly against a wall of a room or into a corner of a room. Such a ratio also can provide for laundry treatment machine that can be conveniently fit into bathroom, for example between a sink or sink vanity cabinet and toilet, or between a toilet and a wall, or between a toilet and a shower or bathtub.

Figure 3:
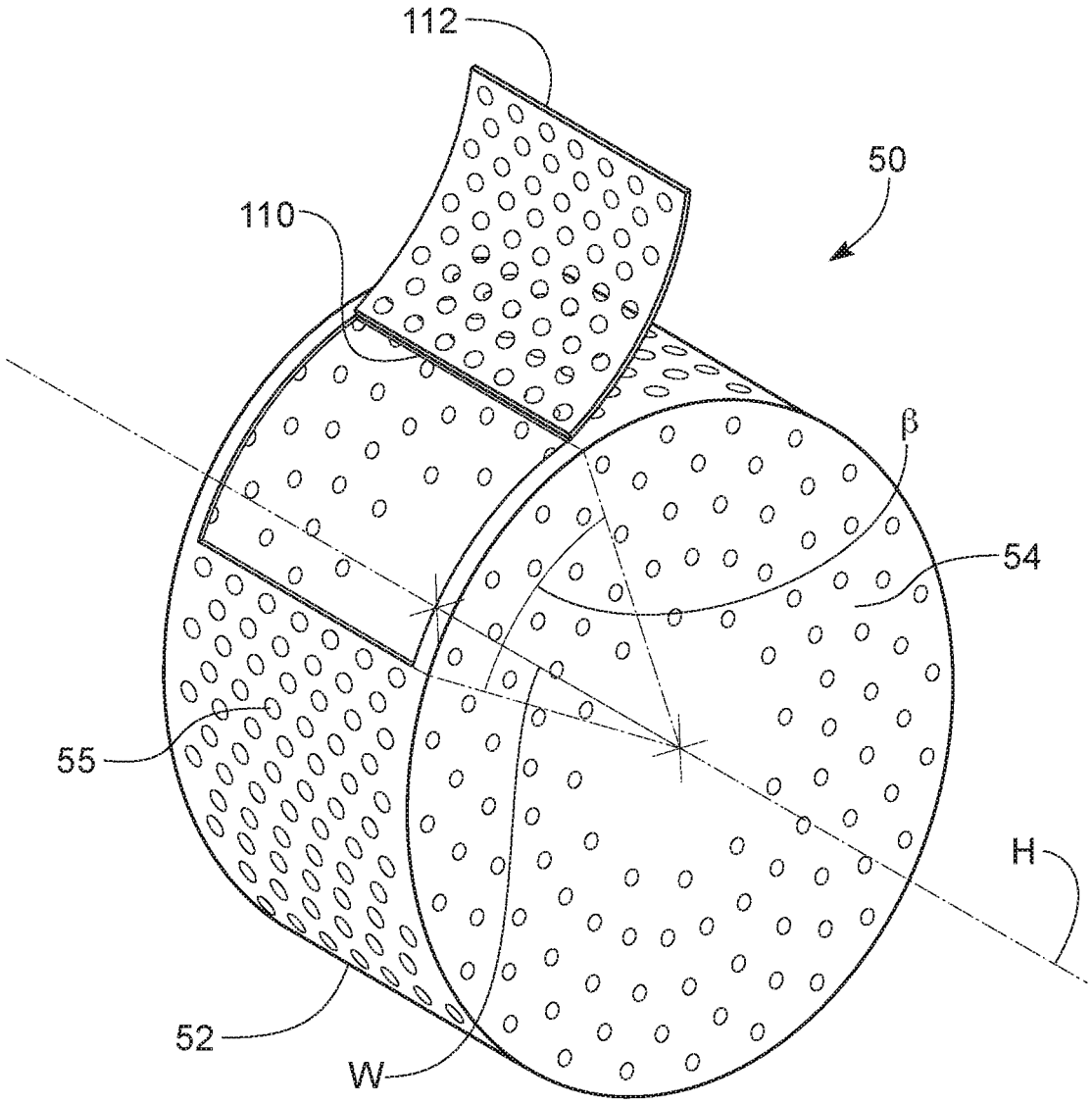
FIG. 3 is a perspective view of a drum.

Average width of the drum 50 is characterized in line with the horizontal axis H. The drum 50 may have various indentions, protrusions, and other features forming part of the side panels 54 (FIG. 3). For instance, there may be an indentation near the horizontal axis H to accommodate the motor that drives the drum. The average width W of the drum 50 is the average distance between the side panels 54 measured parallel with horizontal axis H. To characterize the average width W, individual measurements between the side panels 54 are measured at a center to center spacing of 1 cm. The average width W is the sum of the individual widths measured dived by the number of measurements.

The drum 50 can have a volume from about 0.025 to about 0.06 $m^3$. The drum 50 can have a volume from about 0.035 to about 0.05 $m^3$. A volume of drum 50 in these ranges can provide for sufficient volume to treat, for example by way of washing and/or drying, a small volume of laundry more quickly than a larger laundry treatment machine 10 having a larger volume of drum 50 and require less water during a treatment cycle.

The drum 50 can have a circumferential opening 110, by way of nonlimiting example as shown in FIG. 3. The circumferential opening 110 is in the circumferential wall 52 of the drum 50. The circumferential opening 110 can span an angle of β from 20 degrees to 40 degrees rotationally about the horizontal axis H, which means that the circumferential opening 110 can be as small as 20 degrees up to as large as 40 degrees rotationally about the horizontal axis H. As such 1/18 to 1/9 of the circumference of the drum 50 may comprise the circumferential opening 110. Such a range in size of the circumferential opening 110 can provide for ample radial room for the user to access the interior of the drum 50 but not be so large as to be inconvenient to open and close the circumferential opening 110. A closure 112 can be operably engaged with the circumferential wall 52 so that the circumferential opening 110 can be opened and closed. The closure 112 can be hinged closure. Optionally, the closure 112 can be a sliding closure 112 that is slidingly engaged with the circumferential wall 52 so that the circumferential opening 110 can be opened or closed.

Also shown in FIG. 3 is the averaged width W of the drum. For the drum 50 shown in FIG. 3, the side panels 54 are parallel to one another. In this arrangement, the average width W is the same as any particular width measured.

The drum 50 can have a plurality of apertures 55. The apertures 55 permit the laundry treatment liquor to pass into and out of the drum 50 so that there is fluid communication between the interior of the tub 40 and the interior of the drum 50. The drum 50 can be metal, plastic, coated metal, coated plastic, or other material suitable for long-term use in a wet environment that does not cause significant or any damage to the laundry 20 treated within the drum 50.

The drum 50 can comprise a circumferential wall 52 and a pair of circular side panels 54, together which define the drum 50. The drum 50 distinguishes the interior of the drum 50 from the exterior of the drum 50, the drum 50 being between the interior of the drum 50 and the tub 40. The drum 50 can comprise one or more lifters at, on, or forming the interior of the circumferential wall 52. The lifters can lift the laundry 20 as the drum 50 is rotated and when the lifter approaches the apex of its rotational movement the laundry 20 can tumble away from the interior surface of the circumferential wall 52, which provides mechanical energy to the laundry treatment process.

Figure 4:
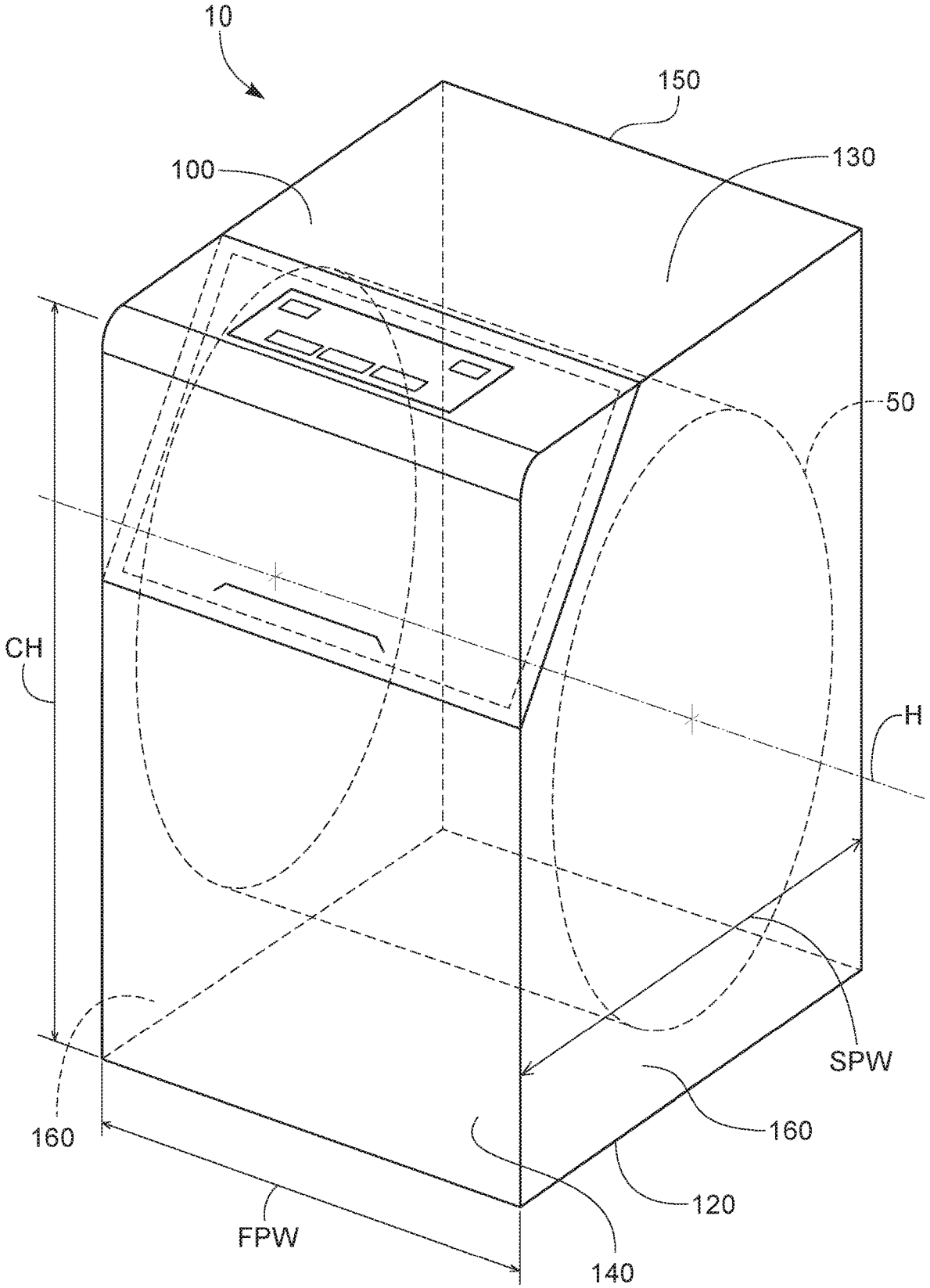
FIG. 4 is a perspective view of a laundry treatment machine.

The cabinet 30 can comprise a base 120, optionally a base panel if the base 120 is finished, beneath the drum 50, a top panel 130 above the drum 50, a front panel 140 and an opposing rear panel 150 extending between the base 120 and the top panel 130, and a pair of side panels 160 extending between the base 120 and the top panel 130 and between the front panel 140 and the rear panel 150, by way of nonlimiting example as shown in FIG. 4. The cabinet 30, and components thereof, can be fabricated from metal or plastic. The horizontal axis H of the drum 50 extends partially between the side panels 160. The cabinet 30 has a cabinet height CH between the extents of the base 120 and the top panel 130, the cabinet height CH being the maximum distance between the outwardly facing surfaces of the base 120 and the top panel 130. The cabinet height CH can be from about 70 cm to about 86 cm, optionally about 75 cm to about 84 cm. A cabinet 30 having such a cabinet height CH can conveniently fit under a table or countertop.

The front panel 140 can have a front panel width FPW between the side panels 160. The front panel height FPH can be from 2 times greater to 2.5 times greater than the front panel width FPW. Arranged as such, the front panel 140 of the laundry treatment machine 10 has a slim profile. The volume of the tub 40 and drum 50 therein is accommodated by the breadth of the side panels 160 between the front panel 140 and the rear panel 150. The front panel width FPW can be from about 30 cm to about 50 cm, optionally about 32 cm to about 47 cm, optionally about 42 cm.

The side panels 160 can have a side panel width SPW between the front panel 140 and the rear panel 150. The side panel width SPW can be from 1.7 to 2.1 times greater than the front panel width FPW. This can similarly provide for a laundry treatment machine 10 having a slim front panel 140 as compared to the side panels 160. The side panel width can be from about 50 cm to about 75 cm, optionally about 63 cm. Such a side panel width SPW can be small enough not to take up an inordinate amount of space in a user's residence and accommodate the tub 40 and drum 50 as described herein.

An attribute to the laundry treatment machine 10 disclosed herein is that the device can fit within a room in more than one orientation and still be practical for the user to use. Traditional top loading laundry treatment machines typically have a hinged door that opens from the front of the machine and swings towards the rear of the laundry treatment machine. A user interface system can be provided at the rearward portion of the top of the laundry treatment machine or optionally on the door 70, or at another position that can be conveniently accessed by the user. The rear of the laundry treatment machine is typically positioned to be facing a wall so that the connection to the water lines and electrical outlet are hidden from view and so that the user interface system is facing the user when the user interacts with the laundry treatment machine. Similarly, traditional front loading laundry treatment machines have a hinged door that opens from one side of the laundry treatment machine and swings toward the other side of the laundry treatment machine. The user interface system for front loading laundry treatment machines is typically near the top of the front of the laundry treatment machine 10.

The laundry treatment machine 10 disclosed herein can be arranged in a room such that a side panel 160 can be placed against a wall of a room or the rear panel 150 can be placed against a wall of a room. In either arrangement, the door 70 will be readily accessible by a user. A practical arrangement for small living space might be to place the laundry treatment machine in a corner of the room with a side panel 160 against one wall of a corner and the rear panel 150 against the other wall of the corner. Optionally, the laundry treatment machine 10 can be arranged in a room such that a side panel 160 is against a wall of the room and the front panel 140 and rear panel 150 extend orthogonally away from the wall. The aforesaid arrangements make efficient use of the user's household space and leave the front panel 140 readily accessible to the user.

Figure 5:
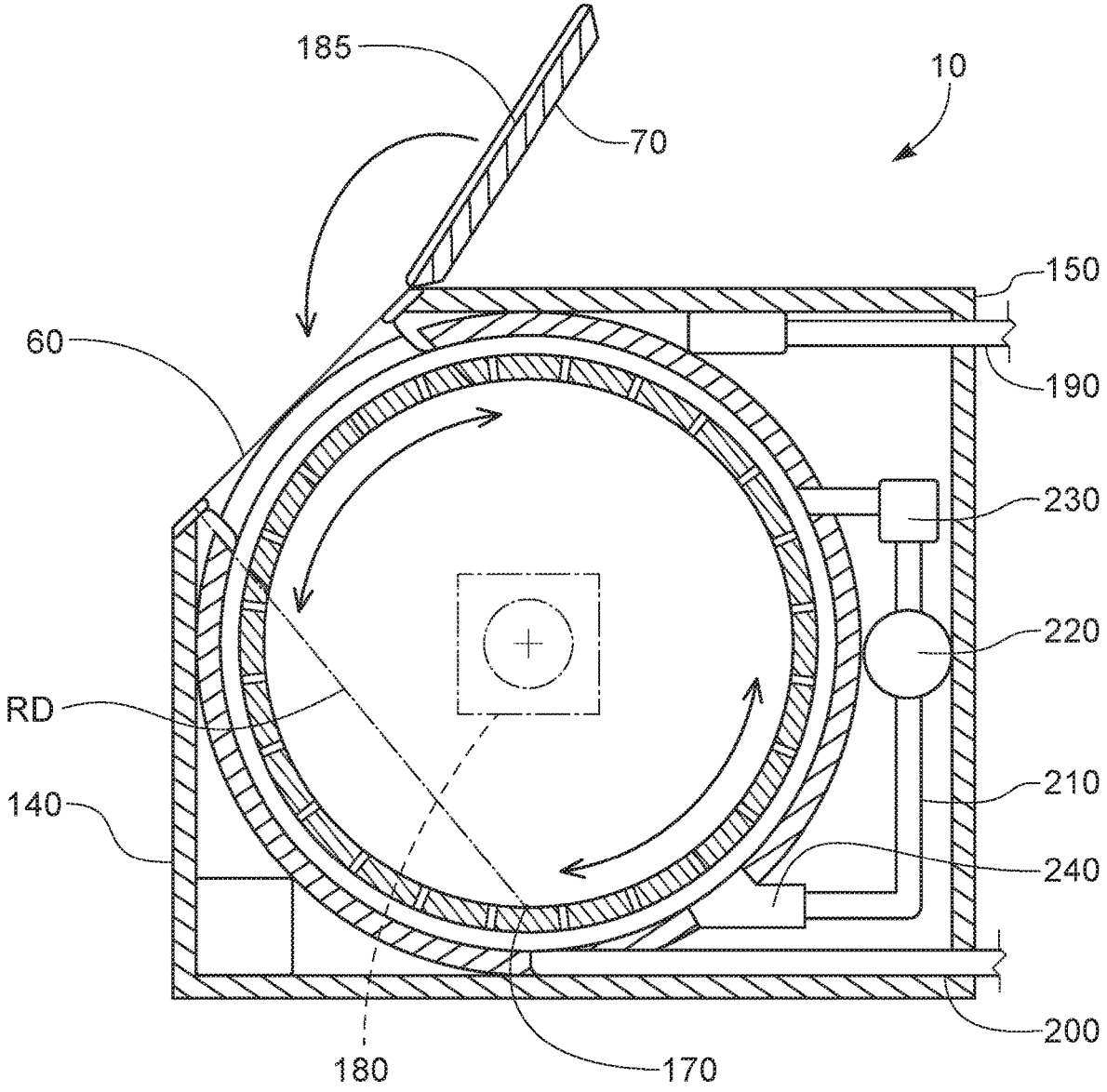
FIG. 5 is a side cross section view of a laundry treatment machine.

The drum 50 has a bottom position 170 that is beneath the horizontal axis H, for example as shown in FIG. 5. The door 70 has an interior facing surface 185 oriented towards the drum 50. The interior facing surface 185 and the bottom position 170 are separated by a reach distance RD less than the diameter D. The reach distance RD is the minimum distance between the interior facing surface 185 of the door 70 and the bottom position 170. The bottom position 170 extends across the interior surface of the drum 50 and is beneath the horizontal axis H and parallel to the horizontal axis H. Such a reach distance RD can make it practical for the user to easily retrieve laundry 20 from the bottom position 170 of the drum 50 after a laundry treatment cycle is completed, particularly as compared to top loading horizontal axis laundry treatment machines. The circumferential entry section 60 positioned as described herein can be thought of as being in a corner position of the cabinet 30 since the circumferential entry section 60 is not completely aligned with the top panel 130 or front panel 140. Locating the circumferential entry section 60 and the door 70 that closes the circumferential entry section 60 as such provides for an arrangement in which the user does not have to reach through the entire diameter D of the drum 50 to access articles of laundry at the bottom position 170 of the drum 50.

The door 70 can be hingedly engaged with the top panel 130, for example as shown in FIGS. 1, 4, and 5. Optionally, the door 70 can be a sliding door 70.

The laundry treatment machine 10 described herein can be an automatic laundry treatment machine 10. The laundry treatment machine 10 can include a motor operably engaged with the drum 50 to rotate the drum 50. The motor 180 can be mounted external to the tub 50 and the drive shaft for the drum 50 can pass through the tub 40, with an adequate sealing structure provided between the drive shaft and the tub 40. The motor 180 can directly or indirectly drive movement of the drum 50. Direct drive can be provided by directly connecting the drive shaft of the motor 180 to the drum 50 without any intermediate gears or belts. Indirect drive can be provided by connecting the drive shaft of the motor to one or more gears and or belts to transmit rotational movement of the drive shaft into rotational movement of the drum 50. The drive shaft of the motor 180 can pass through the wall of the tub 40. Bearings can be provided to rotatably support the drive shaft so that the drum 50 can be maintained in its desired position. And a sealing structure can be provided to seal the tub 40 to drive shaft.

The laundry treatment machine 10 can comprise a liquid inlet 190 into the tub 40. The liquid inlet 190 can be connectable to a water source. Water can be supplied to the tub 40 via the liquid inlet 190. At or downstream of the liquid inlet 190 a liquid control valve 195 can regulate entry of water into the tub 40. The liquid inlet 190 can be above the horizontal axis H or even above the tub 40. A water supply conduit 192 can convey water from the liquid control valve 195 to a laundry treatment active composition supply compartment 194. Water, supplied through the water supply conduit 192, can be supplied to the tub 40 together with a laundry treatment active composition.

The laundry treatment machine 10 can comprise a liquid outlet 200. The liquid outlet 200 can drain liquid from the tub 40 at various stages of a laundry treatment cycle. A liquid control valve 195 can regulate exit of the laundry treatment liquor from the tub 40. Optionally, a pump 197 can be provided to provide energy to transport the laundry treatment liquor from the tub 40 to a household drain.

A typical laundry treatment process includes a step of providing water from a water source. Laundry treatment composition is mixed with the water to form a laundry treatment liquor. The laundry treatment liquid is contacted to the laundry 20. The drum 50 rotates periodically one or more times in one direction or another for some period of time. The periodic movement of the drum 50 raises and drops the laundry 20 so that mechanical energy is applied to the laundry 20 to help treat the laundry 20. Laundry treatment liquor is drained from the drum 50. Water is added to the drum 50 to rinse the laundry treatment liquor from the laundry 20. The drum 50 is rotated at high speed in one direction to drive laundry treatment liquor and rinse water from the laundry 20. The rinse liquid is drained from the laundry treatment machine 10. Multiple rinses may be applied to the laundry 20. After the last rinse, the drum 50 can be rotated at high speeds to remove as much water and or residual laundry treatment liquor from the laundry 20 as is practical.

Figure 6:
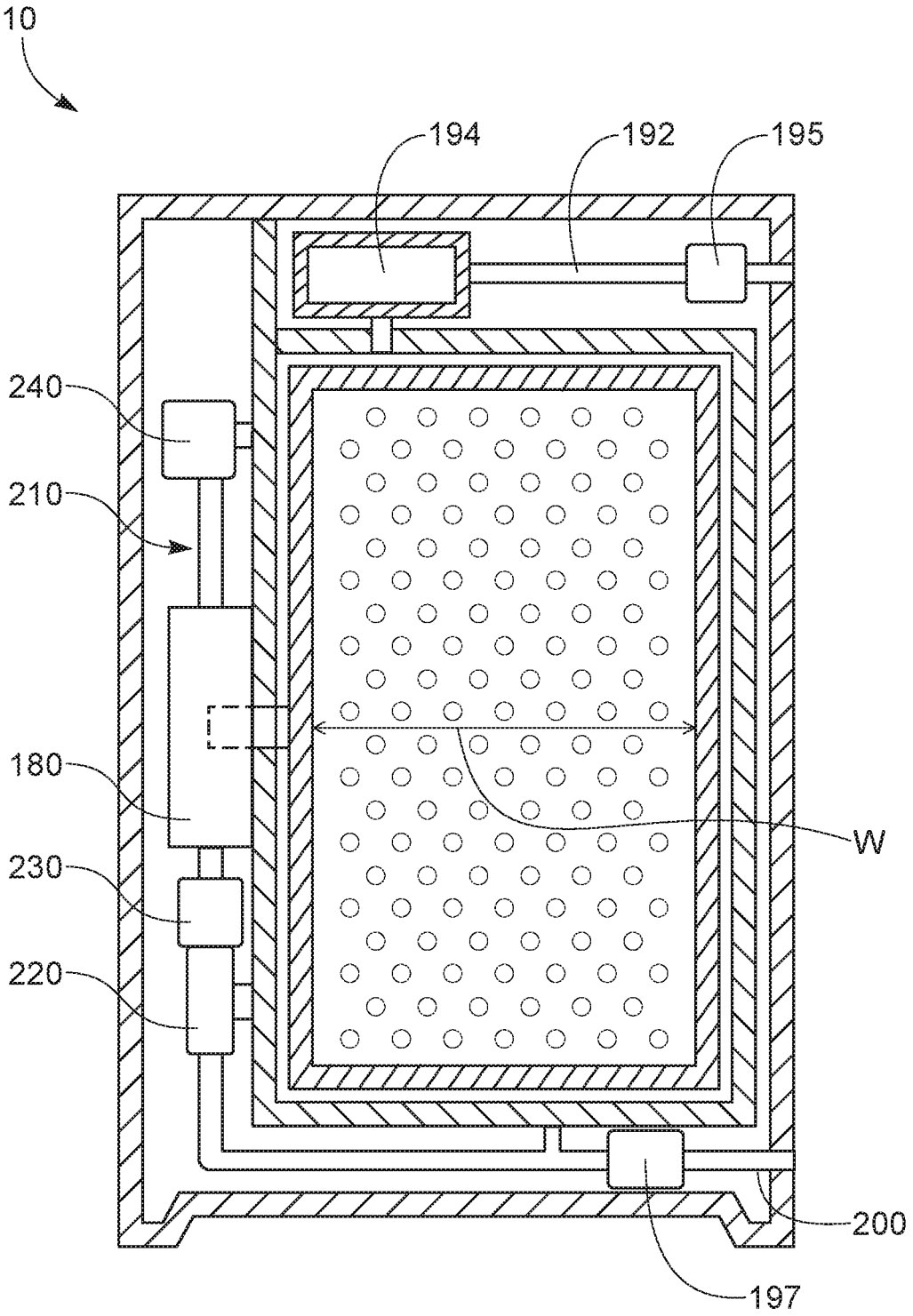
FIG. 6 is a front view of a cross section of a laundry treatment machine that includes a closed drying air circuit.

Optionally, as shown in FIGS. 5 and 6, the laundry treatment machine 10 can further comprise a closed drying air circuit 210 in fluid communication with the tub 40. The closed drying air circuit 210 can comprise a fan 220 and a heater 230. The closed drying air circuit 210 can further comprise a condenser 240 to collect water from within the closed drying air circuit 210.

Providing a laundry treatment machine 10 that includes a closed drying air circuit 210 can be practical for optimizing use of a small living space by a user. A laundry treatment machine 10 that combines the ability to wash and dry laundry 20 can take up less space than two machines, one of which treats laundry 20 and one of which dries laundry 20.

The closed drying air circuit 210 can comprise a heater 220 that heats air circulated in the closed drying air circuit 210. The closed drying air circuit 210 further comprises a fan 230 within the closed drying air circuit 210 that drives air through the closed drying air circuit 210. The closed drying air circuit 210 passes into, through, and out of tub 40 so that the tub 40 is an element within the closed drying air circuit 210. A condenser 240 is within the closed drying air circuit 210, downstream of the tub 40. The condenser 240 condenses air exhausted from the tub 40. The condenser 240 can comprise a thermoelectric module having a heat adsorption side and a heat dissipation side which absorbs and dissipates heat at a junction between two dissimilar metals depending on a direction of electric current flow through the junction. The condenser 240 is positioned so that air exhausted from the tub 40 passes by the heat absorption side of the thermoelectric module.

The laundry treatment machine 10 can be provided with a controller for executing steps of a laundry treatment cycle. The steps of a laundry treatment cycle can include a laundry treatment sub-cycle, a rinse sub-cycle, and optionally a drying cycle. The controller can open and close valves to provide for the ingress and egress of various liquids, and optionally heated air, to and from the tub 40. Water and or laundry treatment compositions can be delivered to the tub 40 at selected times and for selected durations. The controller can also control the motor 180 that drives movement of the drum 50.

The controller can also execute steps required to dry the laundry 20. The controller can control the volumetric air flow rate through closed drying air circuit 210, the temperature of the air driven through the tub 40, removal of water from the air by the condenser 240, and movement of the drum 50 by the motor 180.

Combinations

An example is as follows:

A. A laundry treatment machine (10) comprising:
- a cabinet (30);
- a tub (40) within said cabinet;
- a horizontal axis fluid pervious drum (50) within said tub rotatable about a horizontal axis (H), wherein said drum has a diameter (D) orthogonal to said horizontal axis and an average width (W) in line with said horizontal axis and a ratio of diameter to average width from 1.5:1 to 3.25:1;
- a circumferential entry section (60) into said tub that spans at least across an intermediate range of from 30 degrees to 60 degrees above and rotationally about said horizontal axis and is bounded within a front position of more than 2 degrees above and rotationally about said horizontal axis and a top position less than 90 degrees above and rotationally about said horizontal axis; and
- a door (70) in said cabinet, said door sealingly engaged with said entry section.

B. The laundry treatment machine according to Paragraph A:
- wherein said drum has a circumferential opening (110) spanning at least from 20 degrees to 40 degrees rotationally about said horizontal axis and having a circumferential opening area rotationally about said horizontal axis; and
- wherein said circumferential entry section has a circumferential entry section area greater than said circumferential opening area.

C. The laundry treatment machine according to Paragraph A or B, wherein said cabinet further comprises a base (120) beneath said drum, a top panel (130) above said drum, a front panel (140) and an opposing rear panel (150) extending between said base and said top panel, and a pair of side panels (160) extending between said base and said top panel and between said front panel and said rear panel, wherein said horizontal axis extends partially between said side panels, wherein said cabinet has a cabinet height (CH) between said base and said top panel and a front panel width (FPW) between said side panels, wherein said cabinet height is from 2 to 2.5 times greater than said front panel width.

D. The laundry treatment machine according to Paragraph C, wherein said door is hingedly engaged with said top panel.

E. The laundry treatment machine according to any of Paragraphs A to D, wherein said drum has a bottom position (170) beneath said horizontal axis and said door has an interior facing surface (185) oriented towards said drum and said interior facing surface and said bottom position are separated by a reach distance (RD) less than said diameter.

F. The laundry treatment machine according to any of Paragraphs A to E, wherein said cabinet further comprises a base (120) beneath said horizontal axis drum, a top panel (130) above said horizontal axis drum, a front panel (140) and an opposing rear panel (150) extending between said base and said top panel, and a pair of side panels (160) extending between said base and said top panel and between said front panel and said rear panel, wherein said horizontal axis extends partially between said side panels, wherein said front panel has a front panel width (FPW) between said side panels and said side panels have a side panel width (SPW) between said front panel and said rear panel, wherein said side panel width is from 1.7 to 2.1 times greater than said front panel width.

G. The laundry treatment machine according to any of Paragraphs A to F, further comprising a liquid inlet (190) to said tub, a liquid outlet (200) from said tub, a motor (180) operably engaged with said drum.

H. The laundry treatment machine according to any of Paragraphs A to G, wherein said laundry treatment machine further comprises a closed drying air circuit (210) in fluid communication with said tub, wherein said closed drying air circuit comprises a fan (230) and a heater (220).

I. The laundry treatment machine according to Paragraph H, wherein said closed drying air circuit comprises a condenser (240).

J. The laundry treatment machine according to any of Paragraphs A to I, wherein said drum has a volume from 0.025 to 0.06 $m^3$.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A laundry treatment machine (10) comprising:
- a cabinet (30);
- a tub (40) within said cabinet;
- a horizontal axis fluid pervious drum (50) within said tub rotatable about a horizontal axis (H), wherein said drum has a diameter (D) orthogonal to said horizontal axis and an average width (W) in line with said horizontal axis and a ratio of diameter to average width from 1.5:1 to 3.25:1;
- a circumferential entry section (60) in said cabinet that spans at least across an intermediate range of from 30 degrees to 60 degrees above said horizontal axis and rotationally about said horizontal axis and is bounded within a front position of said cabinet of more than 2 degrees above said horizontal axis and rotationally about said horizontal axis and a top position of said cabinet less than 90 degrees above said horizontal axis and rotationally about said horizontal axis;

a door (70) in said cabinet, said door sealingly engaged with said entry section; and a closed drying air circuit (210) in fluid communication with said tub, wherein said closed drying air circuit comprises a fan (230), a heater (220), and a condenser (240), wherein said condenser comprises a thermoelectric module;

wherein said drum has a circumferential opening (110) spanning at least from 20 degrees to 40 degrees rotationally about said horizontal axis and having a circumferential opening area rotationally about said horizontal axis; and wherein said circumferential entry section has a circumferential entry section area greater than said circumferential opening area.

2. The laundry treatment machine according to claim 1, wherein said cabinet further comprises a base (120) beneath said drum, a top panel (130) above said drum, a front panel (140) and an opposing rear panel (150) extending between said base and said top panel, and a pair of side panels (160) extending between said base and said top panel and between said front panel and said rear panel, wherein said horizontal axis extends partially between said side panels, wherein said cabinet has a cabinet height (CH) between said base and said top panel and a front panel width (FPW) between said side panels, wherein said cabinet height is from 2 to 2.5 times greater than said front panel width.

3. The laundry treatment machine according to claim 2, wherein said door is hingedly engaged with said top panel.

4. The laundry treatment machine according to claim 1, wherein said drum has a bottom position (170) beneath said horizontal axis and said door has an interior facing surface (185) oriented towards said drum and said interior facing surface and said bottom position are separated by a reach distance (RD) less than said diameter.

5. The laundry treatment machine according to claim 1, wherein said cabinet further comprises a base (120) beneath said horizontal axis drum, a top panel (130) above said horizontal axis drum, a front panel (140) and an opposing rear panel (150) extending between said base and said top panel, and a pair of side panels (160) extending between said base and said top panel and between said front panel and said rear panel, wherein said horizontal axis extends partially between said side panels, wherein said front panel has a front panel width (FPW) between said side panels and said side panels have a side panel width (SPW) between said front panel and said rear panel, wherein said side panel width is from 1.7 to 2.1 times greater than said front panel width.

6. The laundry treatment machine according to claim 1, further comprising a liquid inlet (190) to said tub, a liquid outlet (200) from said tub, a motor (180) operably engaged with said drum.

7. The laundry treatment machine according to claim 1, wherein said drum has a volume from 0.025 to 0.06 $m^3$.

* * * * *